US008758524B2

(12) United States Patent
Backherms et al.

(10) Patent No.: US 8,758,524 B2
(45) Date of Patent: Jun. 24, 2014

(54) HOUSEHOLD APPLIANCE WITHOUT A HANDLE

(75) Inventors: Volker Backherms, Osnabrueck (DE); Dominic Beier, Guetersloh (DE); Stefan Tiekoetter, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 0 days.

(21) Appl. No.: 13/226,512

(22) Filed: Sep. 7, 2011

(65) Prior Publication Data

US 2012/0055091 A1 Mar. 8, 2012

(30) Foreign Application Priority Data

Sep. 8, 2010 (DE) ..... 10 2010 037 397

(51) Int. Cl.
*B08B 3/00* (2006.01)

(52) U.S. Cl.
USPC ..... 134/56 D; 134/57 D

(58) Field of Classification Search
USPC ..... 134/56 D; 318/460
See application file for complete search history.

(56) References Cited

U.S. PATENT DOCUMENTS

| | | | | |
|---|---|---|---|---|
| 6,293,149 | B1 | 9/2001 | Yoshida et al. | |
| 2006/0141197 | A1 * | 6/2006 | Caparros Taracido et al. | 428/40.1 |
| 2007/0273475 | A9 * | 11/2007 | Neumann | 340/5.52 |
| 2008/0177436 | A1 * | 7/2008 | Fortson | 701/29 |
| 2008/0190206 | A1 * | 8/2008 | Matsumoto et al. | 73/597 |
| 2011/0036383 | A1 | 2/2011 | Tiekoetter et al. | |
| 2011/0198975 | A1 | 8/2011 | Barkau et al. | |
| 2012/0227773 | A1 | 9/2012 | Rosenbauer et al. | |

FOREIGN PATENT DOCUMENTS

| | | | |
|---|---|---|---|
| DE | 202007006818 | U1 | 10/2007 |
| DE | 202007015532 | U1 | 3/2009 |
| DE | 102008010768 | A1 | 8/2009 |
| WO | WO 9837425 | A1 | 8/1998 |
| WO | WO 2006042819 | A1 | 4/2006 |
| WO | WO 2009132813 | A1 | 11/2009 |

* cited by examiner

*Primary Examiner* — Jason Ko
(74) *Attorney, Agent, or Firm* — Leydig, Voit & Mayer, Ltd.

(57) ABSTRACT

A household appliance includes a door, an opening drive configured to move the door from a closed position into an at least partially open position and a door-opening sensor coupled to the door. The door opening sensor is configured to recognize an acoustically expressed door-opening command and includes a three-axis sensor.

8 Claims, 4 Drawing Sheets

HOUSEHOLD APPLIANCE WITHOUT A HANDLE

CROSS REFERENCE TO RELATED APPLICATIONS

This application claims priority to German Patent Application No. DE 10 2010 037 397.4, filed Sep. 8, 2010, which is hereby incorporated by reference herein in its entirety.

FIELD

The invention relates to a household appliance, especially to a dishwasher without a handle or to a refrigeration appliance without a handle, and having a door.

BACKGROUND

Recently, customers have more and more often been requesting so-called fully integrated household appliances. A fully integrated household appliance is designed without handles. This means that the household appliance can be completely paneled. With such a household appliance, a door or drawer is no longer opened by mechanically pulling on a handle, but rather, by means of an appropriate mechatronic system. In this case, one or more sensors detect a command by a user, and subsequently an opening drive can open the door or drawer.

International application WO 2009/132813 A1 describes a generic fully integrated dishwasher without a handle. For this purpose, a decorative panel is spring-mounted on the door. Moreover, a sensor is provided to detect a relative movement between the decorative panel and the door. Sensors that can be used include especially a force sensor, a piezoelectric sensor, a contact sensor or proximity sensor. In order to reliably make a distinction between a useful signal and an interference signal, this device requires a commensurately high actuation force.

On the other hand, German utility model DE 20 2007 006 818 U1 describes a cabinet with drawers that is configured to recognize when a user acoustically expresses a door-opening command. For this purpose, sound sensors are provided, and it is proposed for a sound sensor to be connected to the drawers by means of a spring-loaded probe, and for another sound sensor to be arranged in the rear area of the cabinet with drawers. The distinction between a useful signal and an interference signal, the so-called signal distinction, is made by evaluating the differences in the propagation time of the signals of both sensors. In order to achieve satisfactory operation, several physically segregated sensors are needed, which involves a certain amount of assembly, contacting and wiring work.

International patent WO 98/037425 describes an acceleration sensor with a deflection sensor element.

German utility model DE 20 2007 015 532 U1 describes a tilt sensor that comprises a three-axis acceleration sensor.

Although the household appliances of the state of the art have proven their worth in daily use, there is a need for improvement, especially in terms of their usefulness.

SUMMARY

In an embodiment the present invention provides a household appliance including a door, an opening drive configured to move the door from a closed position into an at least partially open position and a door-opening sensor coupled to the door. The door opening sensor is configured to recognize an acoustically expressed door-opening command and includes a three-axis sensor.

BRIEF DESCRIPTION OF THE DRAWINGS

Exemplary embodiments of the present invention are described in more detail below with reference to the drawings, in which.

DETAILED DESCRIPTION

Figure 1:
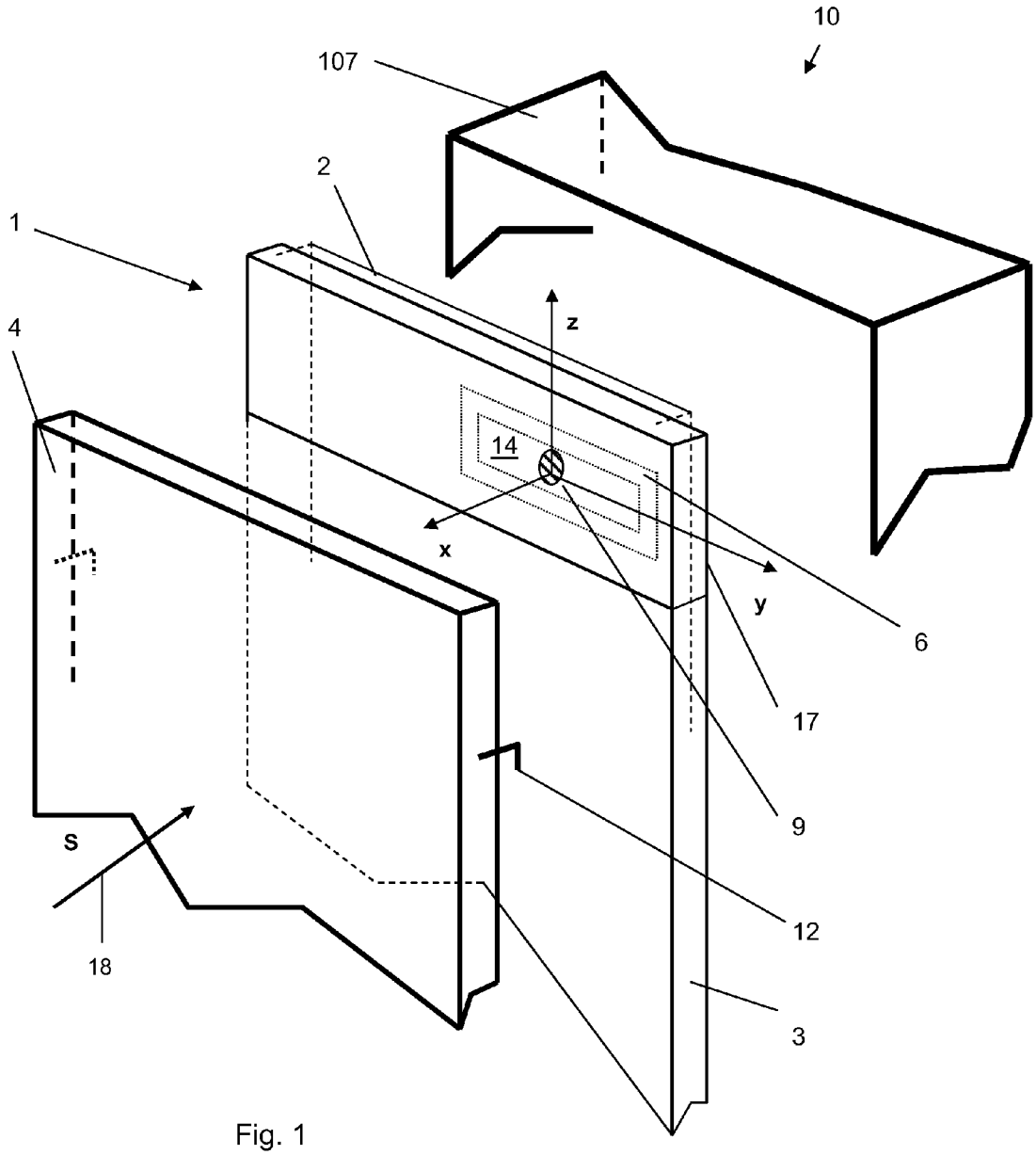
FIG. 1 shows a perspective exploded view of a dishwasher with a door.

In an embodiment, the present invention provides a household appliance in which the door-opening command on the part of a user is detected more reliably.

Thus, in an embodiment, the present invention provides a household appliance, especially a dishwasher without a handle or a refrigeration appliance without a handle, having a door, wherein an opening drive is provided in order to move the door from a closed position into an at least partially open position, wherein a door-opening sensor is provided to recognize an acoustically expressed door-opening command by the user, and wherein said door-opening sensor is coupled to the door.

In an embodiment, the door-opening sensor is a three-axis sensor.

The term three-axis sensor refers to a sensor that measures signals in three spatial directions that are independent of each other. In other words, it is a sensor that measures three-dimensionally, and the three directions of measurement are orthogonal relative to each other.

Consequently, the appliance is able to ascertain the spatial direction from which a signal acts on the household appliance. Thus, in an advantageous manner, it is possible to make a distinction between a useful signal, that is to say, the door-opening command on the part of a user, and interference signals. If, for example, an object is placed on top of the household appliance, a signal, especially a vibration, acts predominantly from above onto the household appliance. According to an embodiment of the invention, such a signal is identified as an interference signal, already solely on the basis of the spatial direction from which it acts on the household appliance. Furthermore, the three-axis sensor is a monolithic element so that, in a synergistic manner, less cabling and assembly work may be used than is the case with the state of the art.

The door-opening sensor may be a three-axis acceleration sensor. Such a sensor measures accelerations, wherein a vibration is proportional to the acceleration. A possible measuring principle of such a sensor is one with which the sensor capacitively measures the deflections of a reference mass. The deflection of the reference mass is proportional to the acceleration. Such sensors can be configured as a micro-electro-mechanical system (MEMS). Advantageously, such a sensor can be used to precisely measure accelerations, while having a fully-integrated design, entailing low costs and requiring only a small installation space. However, the three-axis sensor can also be configured as a three-axis vibration sensor or the like.

According to an embodiment of the invention, the household appliance has a decorative panel. It is connected to the outside, that is to say, the side of the door that is accessible to the user when the door is closed. The decorative panel thus constitutes an interface between the user and the household appliance. In an advantageous manner, the door-opening sensor is mechanically uncoupled from the decorative panel. This means that no direct operative connection exists between the decorative panel and the door-opening sensor. Thus, the door-opening sensor is, in fact, not attached to the decorative panel as is the case with the sensors according to the state of the art, but rather, it is physically segregated from the decorative panel. In an advantageous manner, signals that act on the decorative panel, for example, structure-borne sound, are not transmitted directly to the door-opening sensor.

According to an embodiment of the invention, the decorative panel is connected to the door by means of fastening means. The fastening means can be configured especially as hooks, pins, screws or the like. In an advantageous manner, a signal that acts upon the decorative panel, especially a knocking signal made by the user, can be transmitted to the door via the fastening means. The door-opening sensor is arranged in the door, without having a direct operative connection to the other components of the door. The door-opening sensor can especially be operated by means of an electronic unit.

According to an embodiment of the invention, the decorative panel is made of metal, especially stainless steel. It can also be provided that the decorative panel is configured as a hollow body. The door-opening sensor arrangement according to an embodiment of the invention can allow these decorative panels to be used, since the sensor signals are not hindered by this. Therefore, in an advantageous manner, decorative panels made of metal, especially stainless steel, can be used, which is, in fact, often desired by customers.

In an embodiment, a relatively simple structure of the overall system is achieved, since only one door-opening sensor is used which, owing to the measuring method involving multiple axes, at the same time, ensures a better distinction between the useful signal and the interference signal. It is also advantageous that the door-opening sensor can be mounted with very little work since it can be positioned directly onto an electronic control unit. This translates into a system that functions more reliably, along with a more cost-effective assembly. In an advantageous manner, no additional wiring in the form of signal lines is needed for the door-opening sensor. No modifications have to be made to the dishwasher and/or to peripheral components in order to operate the door-opening sensor. Thus, the invention creates an easy-to-assemble system.

In an embodiment, the door can be opened intuitively by means of knocking, since a user is normally likewise accustomed to knocking on a door, for example, when entering a room. Moreover, this accounts for a high-grade appearance since a user knocks against the household appliance, in contrast to pressing as is known from the state of the art, which, for example, leaves fingerprints behind on the surface of the household appliance.

In an embodiment, the present invention also provides a method for operating a door-opening mechanism for a household appliance, especially for a dishwasher without a handle or a refrigeration appliance without a handle, comprising the following method steps: measuring a first signal by means of a door-opening sensor; measuring a second signal by means of the door-opening sensor; measuring a third signal by means of the door-opening sensor; and determining the spatial direction from which the signal originates by calculating a total signal on the basis of the three measuring signals of the door-opening sensor.

According to an embodiment of the invention, signals, especially accelerations or vibrations from all three spatial directions, are measured from all three spatial directions by means of the door-opening sensor. Data-processing technical means, especially a control computer, reads in and/or evaluates the three signals of the door-opening sensor. In this process, the spatial direction from which a signal is acting on the sensor can be determined. Therefore, it can be advantageously determined whether a signal is acting on the door surface perpendicularly, and thus whether a useful signal is present, or whether a signal came from another spatial direction, for example, because an object was placed onto the household appliance, and thus an interference signal is present. If a useful signal is present, and thus an acoustically expressed door-opening command by the user, an electronic unit can trigger the opening drive, as a result of which the door is moved from the closed position into an at least partially open position.

According to an embodiment of the invention, the signals of the door-opening sensor are filtered so that only a limited frequency band is made available. Thus, a frequency band can be defined in which useful signals, that is to say, opening commands by the user, are expected. Signals that lie outside of this frequency band are filtered out accordingly so as to rule out the triggering of the opening drive at these frequencies. Such filtering can especially be provided in the form of a bandpass filter.

According to an embodiment of the invention, a spectral analysis of the three signals of the door-opening sensor can be calculated and/or evaluated. In an advantageous manner, it can be ascertained whether an appropriate signal amplitude is present at a certain signal frequency, especially at the expected frequency of a knocking signal. If such a signal amplitude is present, the opening of the door is triggered. Consequently, in an advantageous manner, only useful signals bring about the opening of the door.

According to an embodiment of the invention, acceleration integrals of the three signals of the door-opening sensor are calculated and/or evaluated. Thus, in an advantageous manner, this filters the acceleration signals and thus cuts off unwanted frequency ranges. Consequently, useful signals and interference signals can be more reliably distinguished, ensuring dependable operation of the household appliance.

FIG. 1 shows a fully integrated dishwasher 10 without a handle, having a wash chamber 107 and a door 1. The door 1 comprises an inner door panel 2, an outer door panel 3, and a faceplate 17. A device control unit 6 is arranged in the faceplate 17. The device control unit 6 comprises a control printed circuit board 14, and this control printed circuit board 14 holds a door-opening sensor 9. The door 1 also comprises a decorative panel 4 that is connected to the door 1 by fastening means 12. Therefore, the door-opening sensor 9 is arranged in the door 1, without having a direct operative connection with the other components of the door 1. In particular, there is no direct operative connection between the decorative panel 4 and door-opening sensor 9. The decorative panel 4 covers the door 1 completely.

If the door 1 is closed, that is to say, if the door 1 is sealing the wash chamber 107 of the dishwasher 10 so that it is liquid-tight, the door is opened as follows:

A user expresses a door-opening command by knocking S against the decorative panel 4. In FIG. 1, the knocking S is indicated in the direction 18, so it strikes the door surface essentially perpendicularly. The door-opening command on the part of the user is thus especially an acoustically expressed command by the user. The knocking signal S is transmitted from the decorative panel 4 to the door via the fastening means 12. The door comprises the above-mentioned components, and the outer door panel 3, the inner door panel 2, and the faceplate 17 can be connected to each other. The knocking signal S is thus also transmitted to the faceplate 17, and thus also to the device control unit 6, to the control printed circuit board 14 and to the door-opening sensor 9. The door-opening sensor 9 is a three-axis sensor, especially a three-axis acceleration sensor. It measures signals in the three orthogonal spatial directions X, Y, Z shown in FIG. 1.

Figure 3:
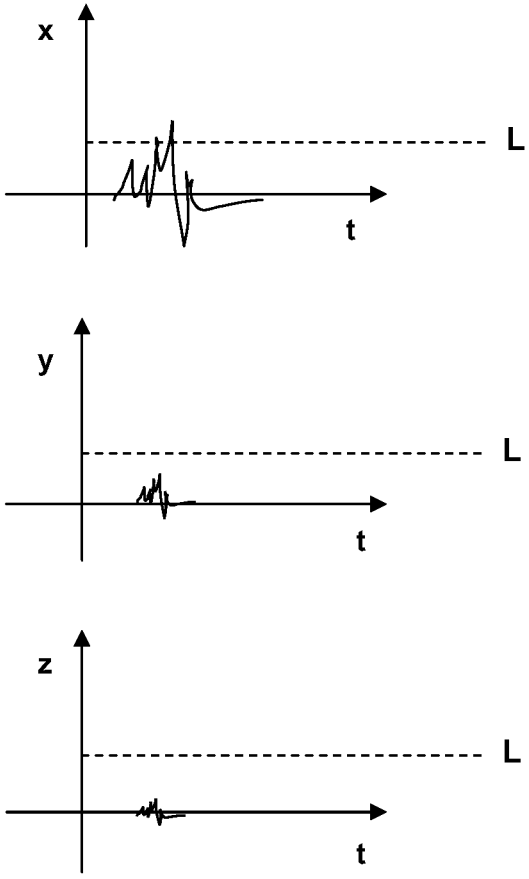
FIG. 3 shows a signal curve of the door-opening sensor.

In the device control unit 6, the three signals of the door-opening sensor 9 are read in and evaluated by means of a control computer. An example of a signal curve of the three axes of the door-opening sensor 9 is shown in FIG. 3 when a knocking signal 18 is present. In each case, one axis indicates the measurement of a signal in one of the spatial directions X, Y, Z. The appertaining signal level is plotted over the time. A value L, shown with a dotted line, forms a threshold value which, when it is exceeded, is evaluated by the device control unit 6. In the present example, the threshold value L is exceeded in the spatial direction X. In this case, the spatial direction X is the spatial direction 18 from which the knocking signal S, that is to say, the useful signal, is expected. Thus, when the threshold value L is exceeded in the spatial direction X, a useful signal is present that constitutes a door-opening command on the part of a user. Subsequently, the device control unit 6 triggers the opening drive of the dishwasher 10 and the door 1 is opened by means of a motor.

If, in the measuring signals shown in FIG. 3, for example, the threshold value L was exceeded in the spatial direction Z, then the device control unit 6 would assess this as an interference signal. A signal amplitude in the spatial direction Z can result, for example, from an object being placed on top of the dishwasher 10. In an advantageous manner, depending on the strength of the signal in the three spatial directions X, Y, Z, the use of the three-axis sensor 9 makes it possible to distinguish between a useful signal and an interference signal.

Figure 2A:
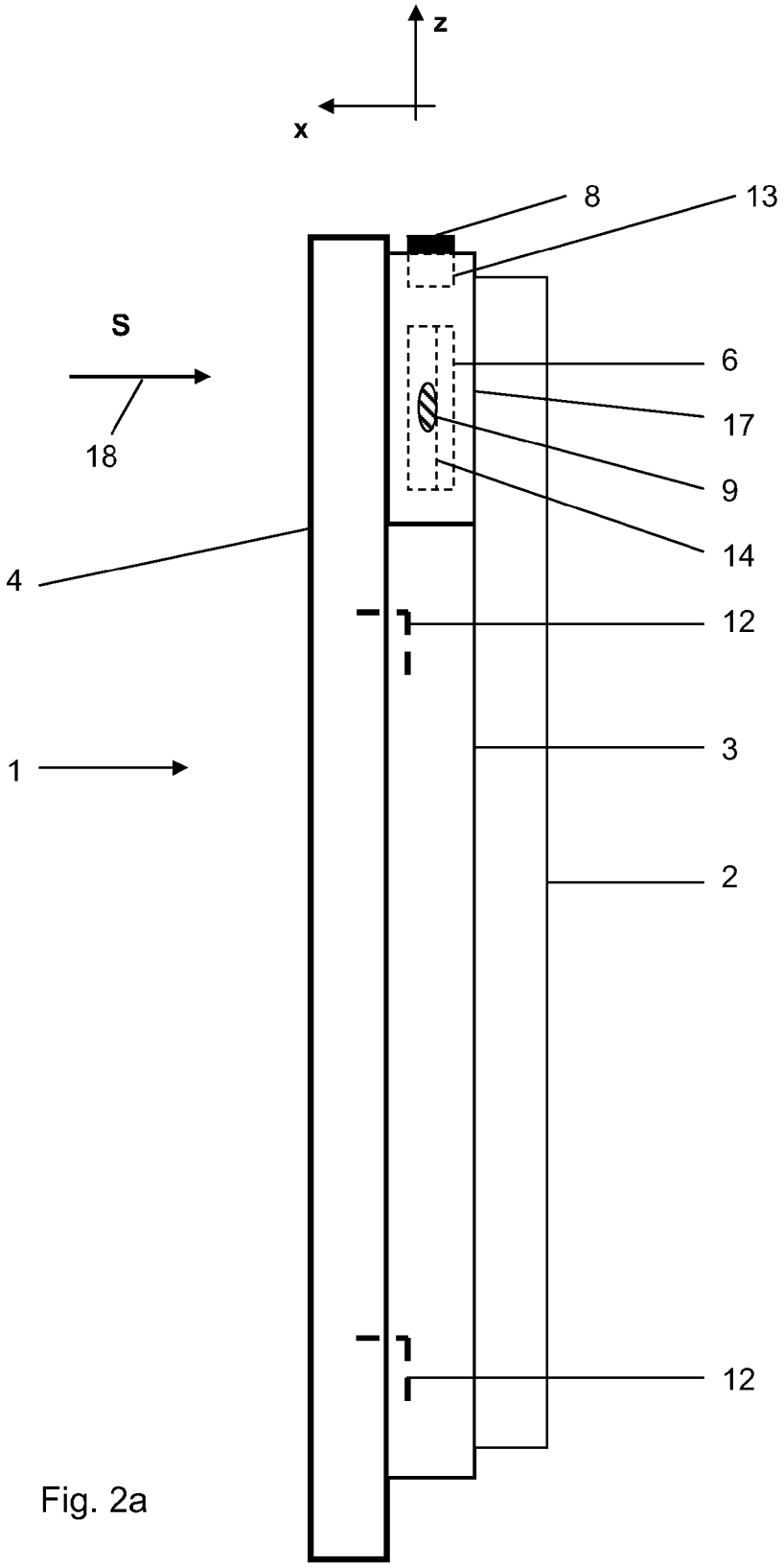
FIG. 2 shows a cross section of a door of the dishwasher with various arrangements of the door-opening sensor (2*a*, 2*b*)
Figure 2B:
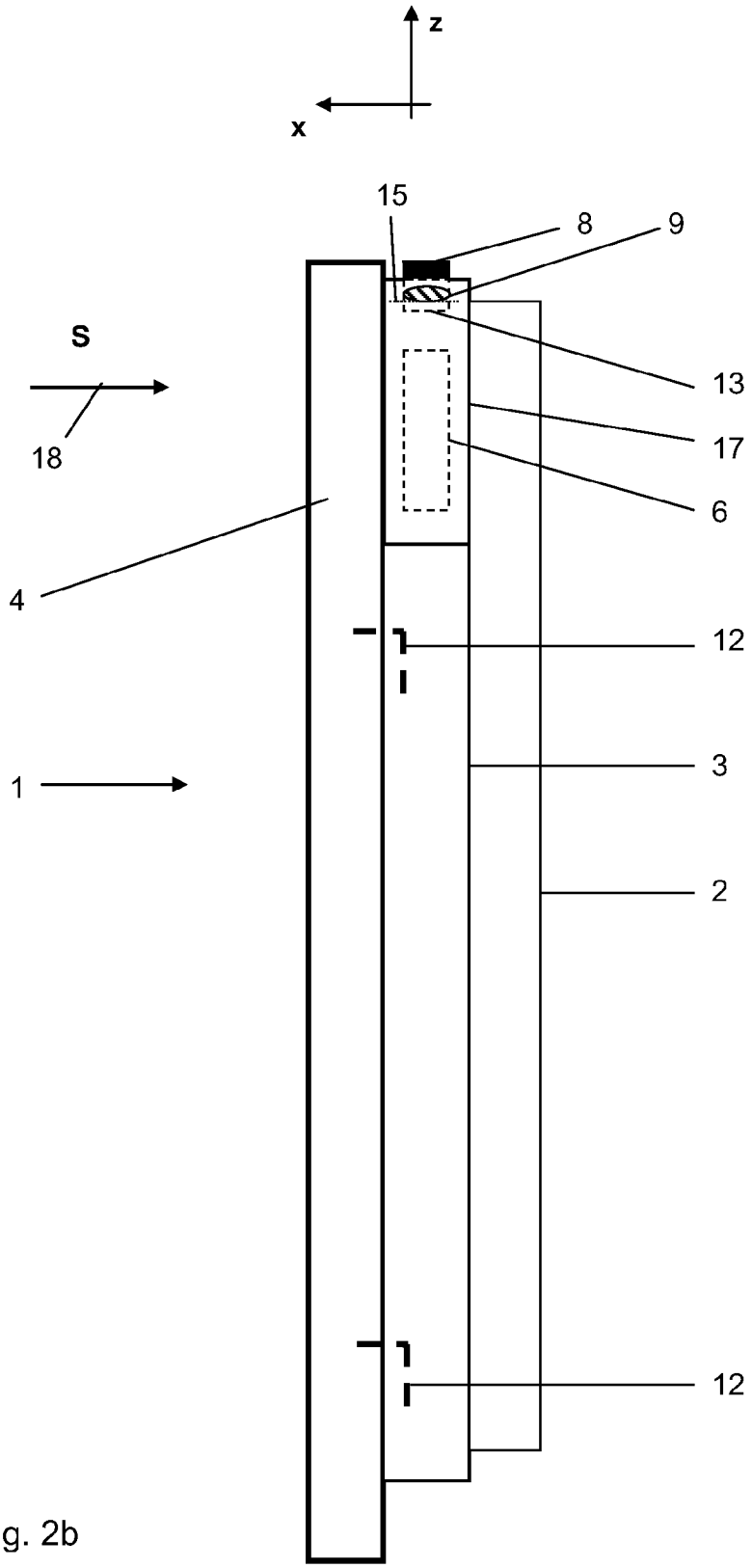

FIGS. 2*a* and 2*b* show two different embodiments of the inventive door 1 of the dishwasher 10. In FIG. 2*a*, the above-mentioned case can be seen, in which the door-opening sensor 9 is held by the control printed circuit board 14 that is arranged inside the device control unit 6 in a faceplate 17. The figure also shows display and operating elements 8 by means of which the user can, for example, select the dishwashing program. The display and operating elements 8 are connected to a display and operating control unit 13. FIG. 2*b* shows an alternative arrangement of the door-opening sensor 9. The door-opening sensor 9 is held by a display and operating printed circuit board 15 that is arranged in the display and operating control unit 13. Other arrangements of the door-opening sensor 9 are likewise conceivable. Here, it should be taken into account that the door-opening sensor 9 measures the useful signals in a different measuring axis as a function of the arrangement in the door 1. Therefore, depending on the arrangement of the door-opening sensor 9, a calibration has to be carried out, as a result of which the measuring axis of the useful signal is determined.

While the invention has been particularly shown and described with reference to preferred embodiments thereof, it will be understood by those skilled in the art that various changes in form and details may be made therein without departing from the spirit and scope of the invention.

What is claimed is:

1. A household appliance comprising:

a door;

a door-opening sensor coupled to the door, the door-opening sensor including a three-axis sensor that measures signals in three independent spatial directions;

a control unit configured to read in the signals from the door-opening sensor and evaluate the signals the signals so as to determine a direction from which a signal source acts on the household appliance; and an opening drive that is triggered by the control unit based on the evaluation of the signals so as to move the door from a closed position into an at least partially open position.

2. The household appliance recited in claim 1, wherein the appliance includes a dishwasher without a handle.

3. The household appliance recited in claim 1, wherein the appliance includes a refrigerator without a handle.

4. The household appliance recited in claim 1, further comprising a decorative panel, wherein the door-opening sensor is mechanically uncoupled from the decorative panel.

5. The household appliance recited in claim 4, wherein the decorative panel is connected to the door by a fastener.

6. The household appliance recited in claim 4, wherein the decorative panel includes a metal.

7. The household appliance recited in claim 1, wherein the door-opening sensor is a three-axis acceleration sensor.

8. The household appliance recited in claim 1, wherein the door-opening sensor is a three-axis vibration sensor.

* * * * *